US006279897B1

(12) United States Patent
Richards

(10) Patent No.: US 6,279,897 B1
(45) Date of Patent: Aug. 28, 2001

(54) SHEET SEPARATOR DAM

(75) Inventor: Douglas A. Richards, Gardner, KS (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/385,970

(22) Filed: Aug. 30, 1999

(51) Int. Cl.[7] ..... B65H 3/52
(52) U.S. Cl. ..... 271/121; 271/167
(58) Field of Search ..... 271/121, 167

(56) References Cited

U.S. PATENT DOCUMENTS

| | | | |
|---|---|---|---|
| 3,126,122 | | 3/1964 | Sacre . |
| 3,640,524 | | 2/1972 | Fredrickson . |
| 3,871,641 | | 3/1975 | Marx et al. . |
| 4,635,922 | * | 1/1987 | Roetter et al. . |
| 5,527,026 | | 6/1996 | Padget et al. . |
| 5,868,385 | | 2/1999 | Embry et al. . |
| 5,895,040 | | 4/1999 | Oleska et al. . |
| 5,899,450 | | 5/1999 | Gettlfinger et al. . |
| 5,932,313 | * | 8/1999 | Barton ..... 271/121 X |
| 6,065,886 | * | 5/2000 | Embry et al. ..... 271/167 X |

FOREIGN PATENT DOCUMENTS

| | | | |
|---|---|---|---|
| 5-24694 | * | 2/1993 | (JP) . |

* cited by examiner

*Primary Examiner*—David H. Bollinger
(74) *Attorney, Agent, or Firm*—John A. Brady

(57) ABSTRACT

A dam has a plurality of substantially parallel ribs with recesses therebetween. At least one of the recesses has a slat therein with bumps or protrusions along its sheet-engaging surface. If more than one sheet is fed from a stack to the dam, the sheets strike the slat surfaces and bumps, causing the sheets momentarily to stop and then separate.

29 Claims, 4 Drawing Sheets

SHEET SEPARATOR DAM

FIELD OF THE INVENTION

This invention relates to a sheet separator for separating adjacent sheets of media being fed from a stack of sheets so that only one sheet is fed to a process station and, more particularly, to a dam separator separating the uppermost or top sheet of a stack of sheets from the next adjacent sheet during feeding of the top sheet from the stack of sheets of media.

BACKGROUND OF THE INVENTION

One problem in feeding a top or bottom sheet of media from a stack of sheets of media is that the sheets may stick together and at least the next adjacent sheet may be fed at the same time. Accordingly, various separating means have been suggested for separating a top sheet of a stack of sheets of media from the next adjacent sheet when the feed is from the top of the stack of sheets of media and for separating a bottom sheet of a stack of sheets of media from the next adjacent sheet when the feed is from the bottom of the stack of sheets of media. This problem is particularly acute when feeding labels, as labels are formed on a thick medium with numerous ridges and valleys that interlock from one sheet to the next, causing the sheets to stick together. Also, certain label materials, such as vinyl, tend to stick together.

It is known to separate a top sheet of a stack of sheets from the next adjacent sheet through using a dam, which is an element having an inclined surface in the path of the top sheet, as it is fed from the stack of sheets, so that its leading edge will strike the inclined surface of the element. In a printer, however, the advancement of more than one sheet from the stack of sheets can cause jamming. Therefore, it is necessary to avoid simultaneous advancement of more than one sheet from a stack of sheets of media to a processing station such as a printer, for example.

Additionally, a surface having a coefficient of friction capable of reliably separating heavy media such as labels, for example, tends to fail to feed at all sheets of a light weight or high friction media such as bond or xerographic paper, for example. This presents the problem of whether an inclined surface of a dam should be capable of reliably feeding and separating heavy media or light media. This is not desirable with a printer since a printer needs to be capable of printing both heavy and light media to have a sufficient market.

U.S. Pat. No. 5,899,450 to Gettelfinger et al. discloses a sheet separator dam with a plurality of ribs and an inset friction element, such as a pad. The pad surface has a coefficient of friction substantially equal to the sheet to sheet friction. If more than one sheet is fed from a stack to the dam, the sheets strike the rib surfaces of the dam first, and then the pad surface, if not separated from each other by the rib surfaces. The frictional step function separates the top sheet from the next adjacent sheet. In such an arrangement, however, the pad must be made of a material having a high coefficient of friction, such as rubber or a special plastic, which is relatively expensive. The pad wears in time and must be replaced at substantial expense. Also, a rubber pad may mar bond paper and leave an undesirable black mark. Still further, this arrangement does not reliably separate the top sheet where the sheets have unusual characteristics, such as labels.

SUMMARY OF THE INVENTION

The sheet separator of the present invention overcomes the foregoing problems through successfully separating both heavy media and light or high friction media with a dam having an inclined, ribbed surface. The sheet separator of the present invention accomplishes this through having at least one slat disposed within at least one pair of its ribs. The slats are formed with a series of protrusions or bumps therealong, which engage the sheets and cause them momentarily to stop, when they fan out and thereby separate.

An object of this invention is to provide a sheet separator having a minimum of parts that wear.

Another object of this invention is to provide a sheet separator that is simple to construct.

A still further object of this invention is to provide a sheet separator that is simple and inexpensive to maintain.

An even further object of this invention is to provide a sheet separator that does not mar the surface of sheets fed therethrough.

Other objects of this invention will be readily perceived from the following description, claims, and drawings.

BRIEF DESCRIPTION OF THE DRAWINGS

The attached drawings illustrate preferred embodiments of the invention, in which.

DETAILED DESCRIPTION OF PREFERRED EMBODIMENTS

Figure 1:
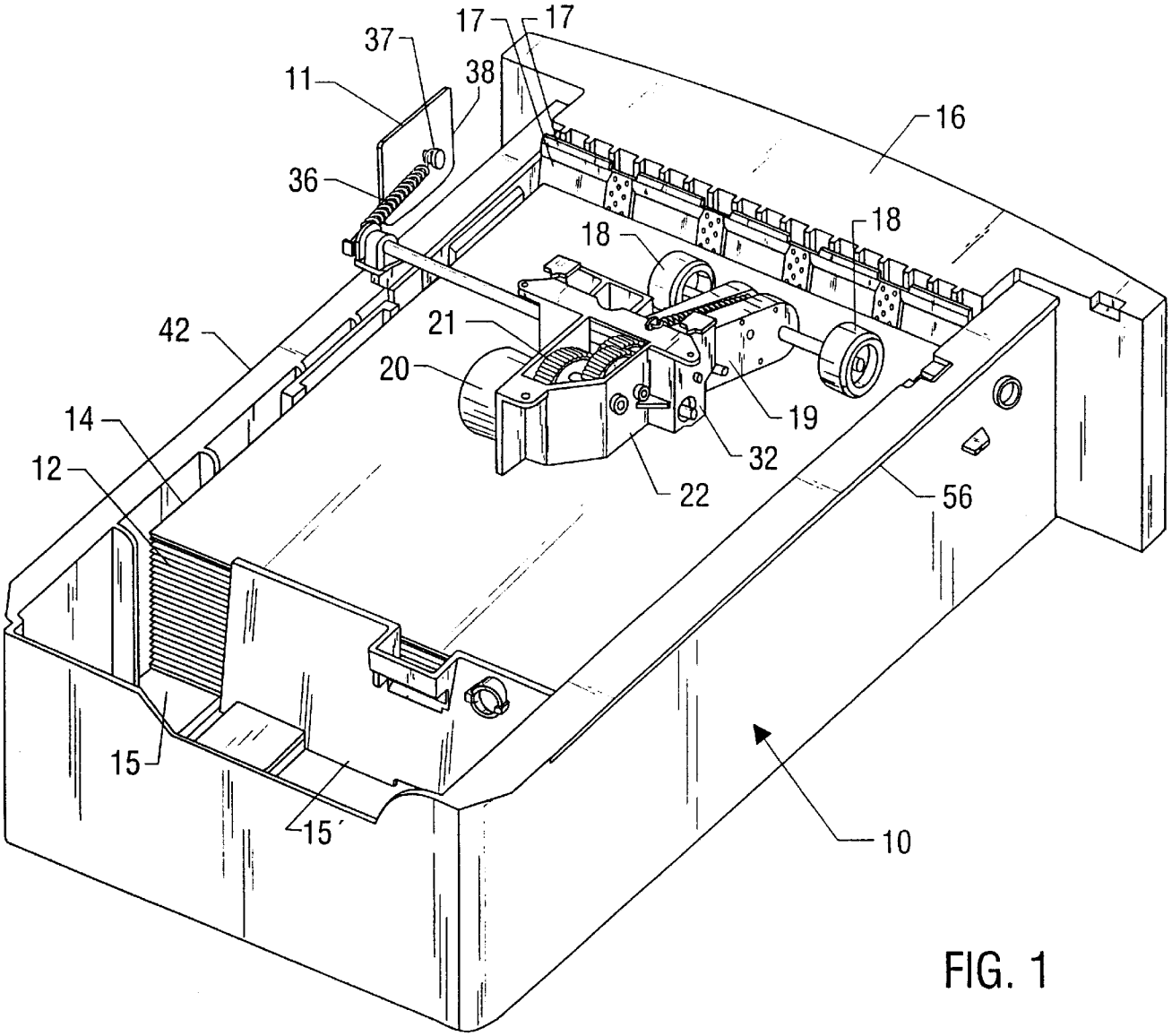
FIG. 1 is a perspective view of a printer tray having the sheet separator of the present invention with a stack of sheets of media therein and shown enlarged for clarity purposes.
Figure 2:
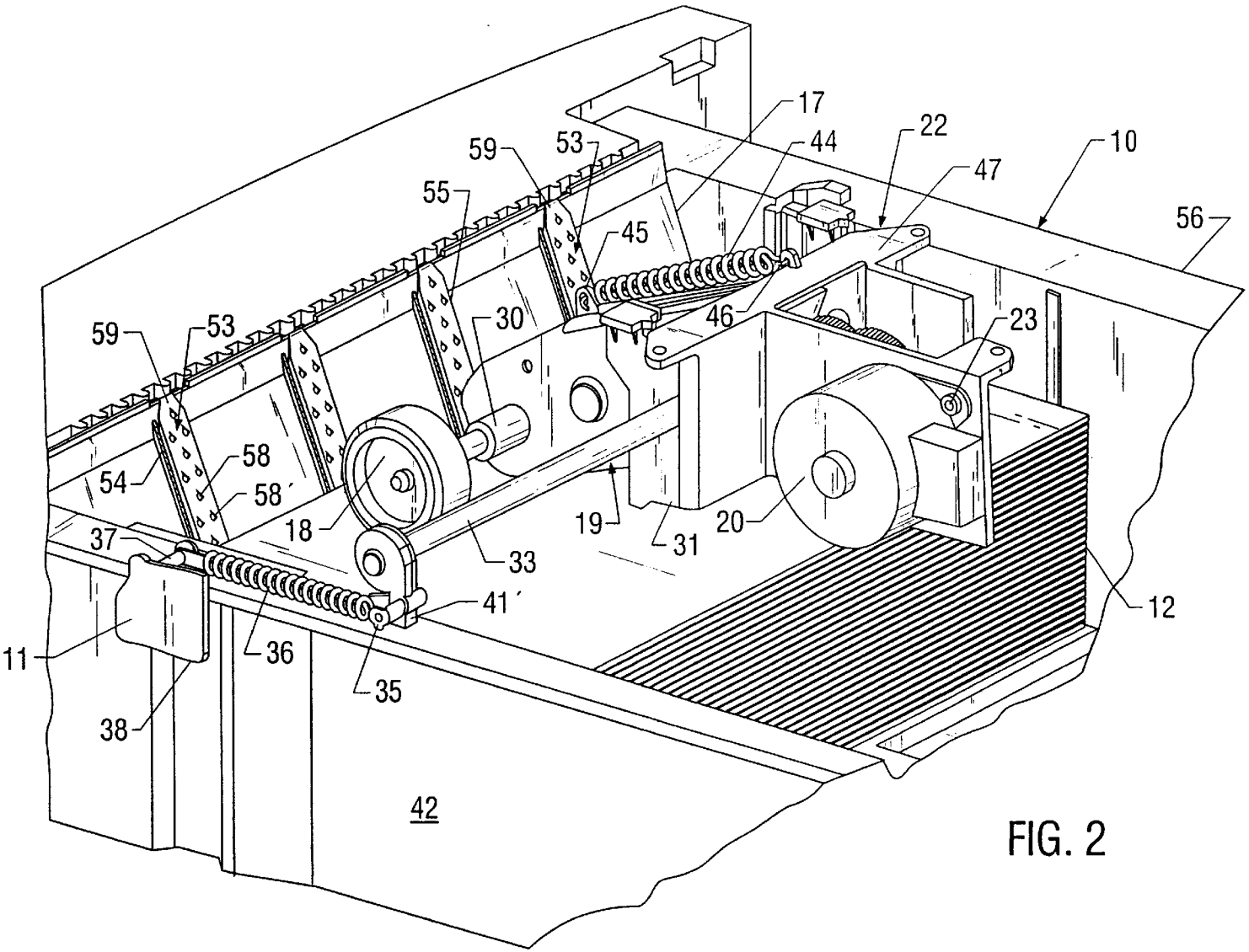
FIG. 2 is an enlarged perspective view of a portion of the tray of FIG. 1 and taken from the opposite side of FIG. 1.

Except for modifications of the dam surface with bumps as will be described, sheet feeding is as described in U.S. Pat. No. 5,932,313 to Barton. Referring to the drawings, and particularly to FIG. 1 thereof, there is shown a tray 10 used in a printer 11. The tray 10 supports a plurality of sheets 12 of a media such as bond paper, for example, in a stack 14. The sheets 12 may be other media such as labels or envelopes, for example.

The tray 10 has a bottom surface or wall 15 supporting the stack 14 of the sheets 12 therein. The tray 10 has a rear restraint 15' abutting a trailing edge of each of the sheets 12 of the stack 14. Adjacent its front end 16, the tray 10 has an inclined surface or wall 17 integral with the bottom surface 15 of the tray 10.

The surface 17 is inclined at an obtuse angle to the bottom surface 15 of the tray 10 and to the adjacent end of the stack 14 of the sheets 12. In one embodiment, it was 19.5° from the vertical. The inclined or angled surface 17 constitutes a portion of a dam against which each of the sheets 12 in the stack 14 is advanced into engagement. The dam also includes a vertical surface 17' above the inclined surface 17. The sheet 12 is advanced from the vertical surface 17' towards a processing station of the printer 11 at which printing occurs.

Each of the sheets 12 is advanced from the stack 14 of the sheets 12 by a pair of feed rollers 18, which are rotatably mounted on a pivotally mounted arm 19. The feed rollers 18 are driven from a motor 20 through a gear drive train 21. The motor 20 is alternately turned off and on by control means (not shown) as each of the sheets 12 is advanced from the top of the stack 14 of the sheets 12.

The motor 20 is supported on a bracket 22 by screws 23 (one shown). The bracket 22 is fixed to a sheet metal portion of the printer 11.

The pivotally mounted arm 19 has a sleeve 30 fixed thereto. The sleeve 30 is rotatably supported by a pair of substantially parallel vertical walls 31 and 32 of the bracket 22 through a pivot shaft 33 extending through the walls 31 and 32 and being rotatably supported thereby.

A bellcrank 34 is mounted on one end of the pivot shaft 33 and fixed thereto. The bellerank 34 has a spring connector 35 fixed thereto and to which one end of a spring 36 is secured. The spring 36 has its other end connected to a post 37 (see FIG. 1) extending from a side frame 38 of the printer 11.

The spring 36 continuously urges the bellcrank 34 clockwise to hold the pivotally mounted arm 19 in a raised position in which the feed rollers 18 cannot engage a top sheet 41 (see FIG. 5) of the stack 14 (see FIG. 1). This occurs when the tray 10 is removed from the printer 11.

When the tray 10 is inserted within the printer 11, a vertical wall 41' extending upwardly from a side wall 42 of the tray 10 engages the bellcrank 34 to rotate the bellcrank 34 counterclockwise against the force of the spring 36. This counterclockwise rotation of the bellcrank 34 causes counterclockwise rotation of the pivot shaft 33, which has the bellcrank 34 fixed thereto. The pivotally mounted arm 19 then pivots counterclockwise because of gravity so that the feed rollers 18 engage the top of the stack 14 (see FIG. 1) of the sheets 12.

A counterbalance spring 44 extends between an ear 45 on the pivotally mounted arm 19 and an ear 46 in a flat portion 47 of the bracket 22. The counterbalance spring 44 limits the force applied by the feed rollers 18 to the top of the sheets 12 (see FIG. 1) in the stack 14.

When the feed rollers 18 are in the feed or sheet advance position in which they engage the top sheet 41 (see FIG. 5) of the stack 14 (see FIG. 1) of the sheets 12, the top sheet 41 (see FIG. 5) of the stack 14 (see FIG. 1) is advanced by rotation of the feed rollers 18 through energization of the motor 20. This causes leading edge 49 (see FIG. 4) of the top sheet 41 to engage the inclined surface 17 (see FIG. 1) of the tray 10, which is preferably formed of plastic.

Figure 3:
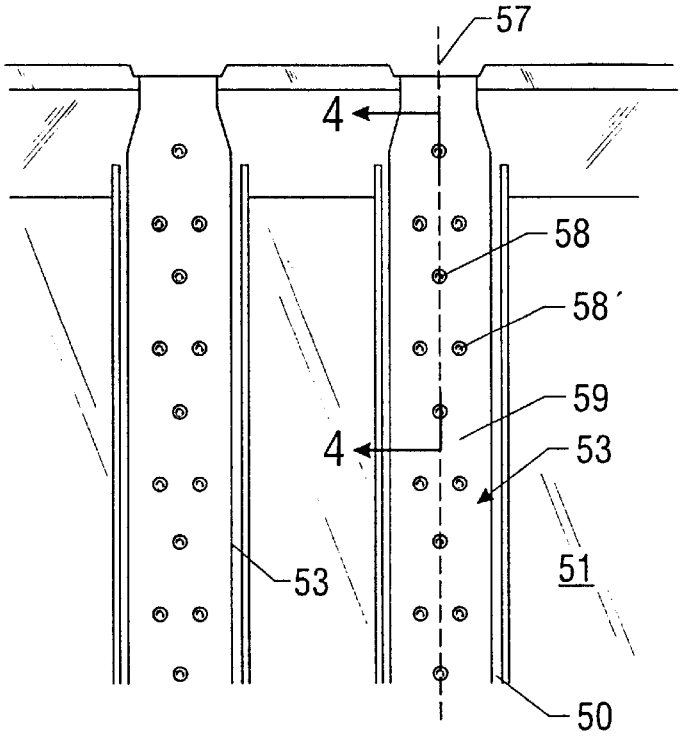
FIG. 3 is an enlarged fragmentary plan view of a portion of the dam of FIG. 1 showing slats with bumps or protrusions thereon inserted in the parallel ribs of the dam.
Figure 6:
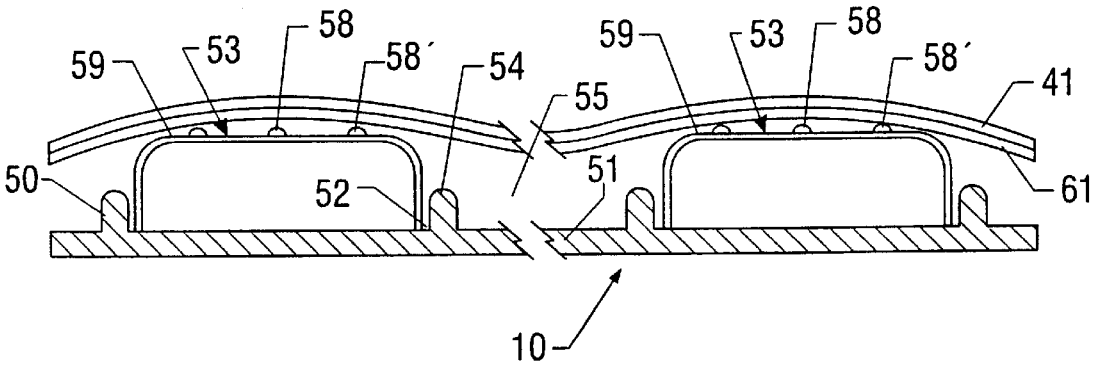
FIG. 6 is an enlarged fragmentary schematic sectional view of a portion of the dam of FIG. 1 showing two adjacent contacting sheets striking the slat surfaces of the dam to separate the two sheets, with the sheets shown enlarged for clarity purposes.

The inclined surface 17 includes a plurality of substantially parallel portions or ribs 50 (see FIG. 3) protruding from a base surface 51 (see FIG. 6). Each of the protruding portions or ribs 50 of the inclined surface 17 has a recess 52 therein to receive a slat or slide 53 protruding beyond extensions 54 of each of the protruding portions 50 of the inclined surface 17. The extensions 54 are positioned on each side of each of the plurality of substantially parallel slats 53 to form the side walls of each of the recesses 52 in the tray 10 in which the slats 53 are retained. The slats 53 may be formed of any suitable low friction material but are preferably formed of stainless steel.

A recess 55 is formed in the inclined surface 17 between each adjacent pair of the protruding portions or ribs 50. The recesses 55 also are formed in the inclined surface 17 between one of the outermost of the protruding portions or ribs 50 and the side wall 42 (see FIG. 1) of the tray 10 and between the other of the outermost of the protruding portions 50 (see FIG. 6) and a side wall 56 (see FIG. 1) of the tray 10.

Each slat 53 (see FIG. 3) has a plurality of protrusions or bumps 58, 58' positioned along a median line 57 parallel to the paper feed direction and extending from an exterior surface 59 thereof. The protrusions 58, 58' are slightly convex protuberances or knobs formed in the slats 53 (see FIG. 4) and have a substantially uniform circular maximum diameter at the base and a substantially uniform height. In one exemplary embodiment, the protrusions 58, 58' ranged in height from about 0.010 to 0.016 inches, and had a maximum diameter at the base ranging from about 0.050 to 0.060 inches. The protrusions 58, 58' can be punched or hammered with a punch, a hammerless hole punch or with other suitable fabrication tools. The slat 53 may rest upon a suitable anvil such as a wooden two-by-four. In a preferred embodiment, a hammerless hole punch was used, as it delivered a reliable and repeatable punching force to the slat 53 upon each application. In the illustrated embodiment, the protrusions 58, 58' have a generally uniform diameter, and are evenly spaced in alternating groups of one protrusion 58 adjacent a pair of protrusions 58' (see FIG. 3) along the median line 57 of the slats 53. In one practical embodiment, the protrusions 58, 58' were spaced along the paper feed direction approximately 7/16th inch to ½ inch apart, and alternated between pairs of protrusions 58' and single protrusions 58 in a "hopscotch" pattern. It is believed that the protrusions 58, 58' could be as closely spaced as ⅜ths of an inch, and would still function as hereindescribed. Other spacings of the protrusions 58, 58' have been tried, but the aforedescribed hopscotch pattern was found to produce the most reliable and repeatable separation of sheets 12 and consequent correct feeding thereof to the printing station.

Figure 4:
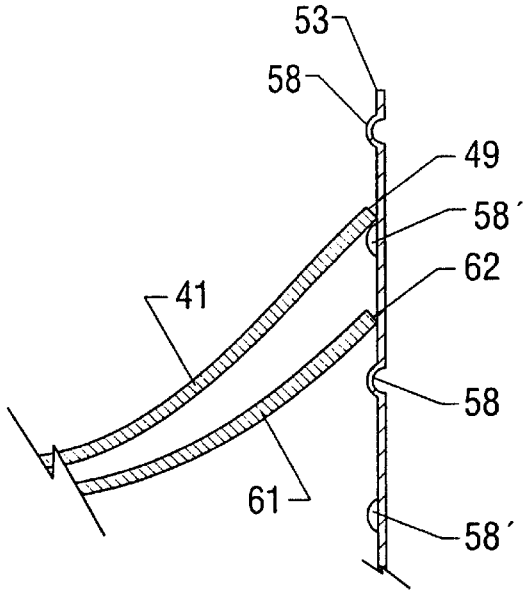
FIG. 4 is a cross-sectional view taken along the lines 4—4 of FIG. 3, with the protrusions shown enlarged for clarity purposes.

When the top sheet 41 of the stack 14 (see FIG. 1) of the sheets 12 is advanced therefrom, the leading edge 49 (see FIG. 5) of the top sheet 41 initially engages the exterior surfaces 59 and the protrusions 58, 58' of the slats 53 (see FIG. 4).

Figure 5:
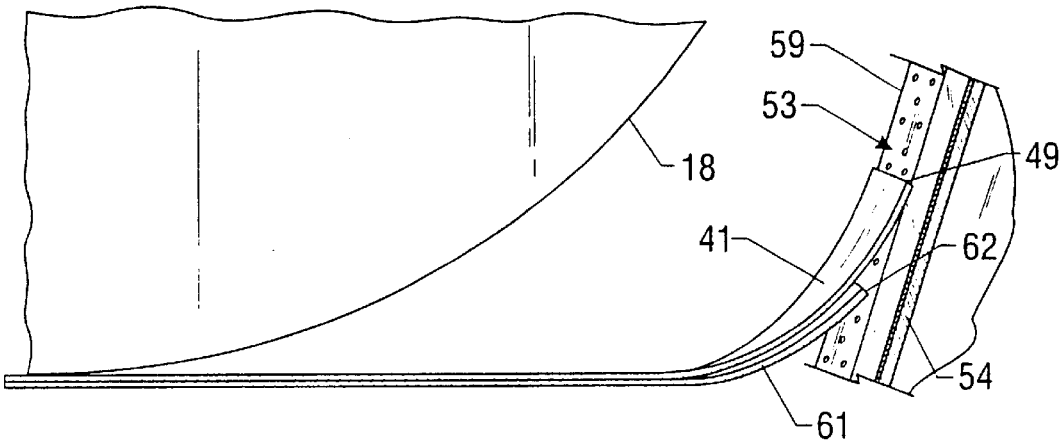
FIG. 5 is a schematic side elevational diagram showing one of the three possible relationships of two adjacent contacting sheets striking a slat surface, with the sheets shown enlarged for clarity purposes.

If a next adjacent sheet 61 in the stack 14 (see FIG. 1) also has been advanced from the stack 14 with the top sheet 41 (see FIGS. 4 and 5), its leading edge 62 also will have engaged the exterior surfaces 59 and the protrusions 58, 58' of the slats 53 and the leading edges 49, 62 thereof will momentarily halt or stop (see FIGS. 4 and 5.) This halting or stopping action of the leading edges 49, 62 is believed to cause the sheets 41, 61 to buckle and fan out (see FIG. 4), permitting air to pass therebetween and thereby space the sheets 41, 61 from each other. The upper sheet 41 then pulls away from the lower sheet 61 and continues to be advanced along the exterior surfaces 59 of the slats 53 after there has been separation of the two adjacent sheets 41 and 61.

The lower sheet 61 then falls back into the stack 14 in the tray 10 by the action of gravity. The sheet 61 then becomes the uppermost sheet in the stack 14 and is next fed to the printing station by the feed rollers 18.

As schematically shown in FIG. 5, the leading edge 49 of the top sheet 41 can engage the exterior surface 59 before the leading edge 62 of the next adjacent sheet 61. It should be understood that the leading edge 62 of the next adjacent sheet 61 could engage the exterior surface 59 before the leading edge 49 of the top sheet 41 or both the leading edges 49 and 62 could simultaneously engage the exterior surface 59. Thus, there are three different possibilities of the leading edges 49 and 62 engaging the exterior surface 59, but each produces separation of the sheets 41 and 61 due to the stopping or fanning action of the protrusions 58, 58' of the slats 53.

It should be understood that the motor 20 (see FIG. 1) must produce a sufficient torque to overcome the friction forces incurred by one or more of the sheets 12 striking the exterior surfaces 59 and the protrusions 58, 58' of the slats 53.

One suitable example of the material of the slat 53 is stainless steel having a coating on exterior surface 59 of TEFLON fluoropolymer, a low coefficient of friction material. The exterior surface 59 of each of the slats 53 has a coefficient of friction of less than 0.15 with respect to paper.

While the sheet separator of the present invention has been shown and described as being used with a printer, it should be understood that the sheet separator of the present invention may be used with any apparatus feeding a sheet from a stack to a processing station, for example, in which only one sheet at a time is to be fed from the stack to the processing station.

An advantage of this invention is that a sheet feeding mechanism can feed sheets of media in which the sheets in one stack of sheets are of substantially the same thickness but a different thickness than the sheets in another stack, for example, the one stack being paper and the other stack being labels. A still further advantage of this invention is that is relatively inexpensive to manufacture, being made of a simple material such as stainless steel hammered with indentations or dimples. An even further advantage of this invention is that it is very durable, especially if the slats are made of stainless steel. Another advantage of the present invention is that it is easy to repair or replace if it malfunctions. A still further advantage of this invention is that it can be easily retrofitted to existing printers at low cost. An even further advantage of this invention is that it can be used in a printer tray containing a large number of sheets of media.

For purposes of exemplification, particular embodiments of the invention have been shown and described according to the best present understanding thereof. However, it will be apparent that various changes and modifications in the arrangement and construction of the parts thereof may be made without departing from the spirit and scope of the invention as defined in the appended claims.

What is claimed is:

1. A sheet separator containing a stack of individual sheets for separating adjacent sheets adjacent sheets of media being fed from said stack of sheets comprising:

a rotatable sheet feed roller, a surface for supporting a bottom of said stack of sheets, and having a sheet dispensing end, an inclined element located adjacent said end of said surface for supporting, said inclined element being inclined at an obtuse angle to said stack of sheets, said stack having a top opposite said bottom, said sheet feed roller for contacting said top of said stack and being spaced away from said inclined element and being rotatable to move said sheets from said top of said stack into said inclined element, and a plurality of protrusions disposed along the exterior surface of said inclined element, each said protrusion being effective to momentarily stop sheets fed by said sheet feed roller.

2. The sheet separator according to claim 1, wherein said sheets feed in a direction; and wherein said plurality of protrusions are substantially centered along a line parallel to said feed direction of said sheets.

3. The sheet separator according to claim 2, wherein said plurality of protrusions are evenly spaced along said parallel line.

4. The sheet separator according to claim 3, wherein said plurality of protrusions are spaced along said parallel line from about ⅜ths of an inch to about ½ of an inch apart.

5. The sheet separator according to claim 2, wherein each of said plurality of protrusions are substantially circular in cross-section.

6. The sheet separator according to claim 5, wherein said plurality of protrusions are from about 0.010 inches to about 0.016 inches in height.

7. The sheet separator according to claim 5, wherein each of said plurality of protrusions has a base with a maximum diameter; and wherein said maximum diameters of said protrusions are from about 0.050 inches to about 0.060 inches.

8. The sheet separator according to claim 2; wherein said plurality of protrusions are arranged in a pattern of a single protrusion alternating with a pair of protrusions.

9. The sheet separator according to claim 2; wherein said plurality of protrusions are arranged in a hopscotch pattern of alternating single and double protrusions.

10. The sheet separator according to claim 1; and further comprising a slat disposed on said inclined element which engages the end of sheets moved by said rotation of said feed roller, and wherein said plurality of protrusions are disposed along said slat.

11. The sheet separator according to claim 10; and further comprising two protruding ribs disposed on said inclined element, and wherein said slat is disposed between said pair of protruding ribs.

12. The sheet separator according to claim 11; and further comprising a plurality of pairs of protruding ribs on said inclined element in addition to said first two ribs, said plurality of pairs of said ribs being located spaced from said first two ribs, each of said pairs of ribs having a slat with said plurality of protrusions disposed therealong.

13. The sheet separator according to claim 11; and further comprising a stack of individual sheets supported by said surface for supporting, said individual sheets being flexible to permit said sheets to contact said slat and said protrusions when two sheets are moved together from said stack by said feed roller, whereby said upper and lower sheets strike said protrusions to fan out and separate from each other.

14. The sheet separator according to claim 11; wherein said slats are stainless steel.

15. In a sheet separator containing a stack of individual sheets for separating adjacent sheets of media being fed from said stack of sheets, a rotatable sheet feed roller, a surface for supporting a bottom of said stack of sheets, and having a sheet dispensing end, an inclined element located adjacent said end of said surface for supporting, said inclined element being inclined at an obtuse angle to said stack of sheets, said stack having a top opposite said bottom, said sheet feed roller for contacting said top of said stack and being spaced away from said inclined element and being rotatable to move said sheets from said top of said stack into said inclined element, the improvement comprising a plurality of protrusions along an exterior surface of said inclined element for engaging said end of said upper sheet when said upper sheet is advanced, each said protrusion being effective to momentarily stop sheets fed by said sheet feed roller whereby said upper and lower sheets strike said plurality of protrusions to fan out and separate from each other.

16. The improvement of claim 15, wherein said sheets feed in a direction; and wherein said plurality of protrusions are substantially centered along a line parallel to said feed direction of said sheets.

17. The improvement of claim 16; wherein said plurality of protrusions are evenly spaced along said parallel line.

18. The improvement of claim 17; wherein said plurality of protrusions are spaced along said parallel line from about ⅜ths of an inch to about ½ of an inch apart.

19. The improvement of claim 16; wherein each of said plurality of protrusions are substantially circular in cross-section.

20. The improvement of claim 19; wherein said plurality of protrusions are from about 0.010 inches to about 0.016 inches in height.

21. The improvement of claim 19, wherein each of said plurality of protrusions has a base with a maximum diameter; and wherein said maximum diameters of said protrusions are from about 0.050 inches to about 0.060 inches.

22. The improvement of claim 16; wherein said plurality of protrusions are arranged in a pattern of a single protrusion alternating with a pair of protrusions.

23. The improvement of claim 16; wherein said plurality of protrusions are arranged in a hopscotch pattern of alternating single and double protrusions.

24. The improvement of claim 15, and further comprising a slat disposed along said inclined element which engages the end of sheets moved by said rotation of said feed roller; and wherein said plurality of protrusions are disposed along said slat.

25. The improvement of claim 24, and further comprising two protruding ribs disposed on said inclined element; and wherein said slat with said plurality of protrusions is disposed between said pair of protruding ribs.

26. The improvement of claim 25; and further comprising a plurality of pairs of protruding ribs on said inclined element, said plurality of pairs of said ribs being located spaced from said first two ribs, each of said pairs of ribs having a slat disposed therein.

27. The improvement of claim 25, wherein said slats are stainless steel.

28. A sheet separator containing a stack of individual sheets for separating adjacent sheets of media being fed from said stack of sheets comprising:

a rotatable sheet feed roller, a surface for supporting a bottom of said stack of sheets, and having a sheet dispensing end, an inclined element located adjacent said end of said surface for supporting, said inclined element being inclined at an obtuse angle to said stack of sheets, said stack having a top opposite said bottom, said sheet feed roller contacting said top of said stack and being spaced away from said inclined element and being rotatable to move said sheets from said top of said stack into said inclined element, said inclined element having a plurality of pairs of protruding ribs which engage the end of sheets moved by said rotation of said feed roller, said inclined element having between each of said pairs of ribs a slat with a plurality of protrusions along an exterior surface thereof, said plurality of protrusions substantially centered on a median line thereof and arranged in a hopscotch pattern of alternating single and double protrusions, and a stack of individual sheets supported by said surface for supporting, said individual sheets being flexible to permit said sheets to contact said slat and said plurality of protrusions when two sheets are moved together from said stack by said feed roller, whereby said upper and lower sheets strike said plurality of protrusions to fan out and separate from each other.

29. In a sheet separator containing a stack of individual sheets for separating adjacent sheets of media being fed from said stack of sheets, a rotatable sheet feed roller, a surface for supporting a bottom of said stack of sheets, and having a sheet dispensing end, an inclined element located adjacent said end of said surface for supporting, said inclined element being inclined at an obtuse angle to said stack of sheets, said stack having a top opposite said bottom, said sheet feed roller contacting said top of said stack and being spaced away from said inclined element and being rotatable to move said sheets from said top of said stack into said inclined element, said inclined element having a plurality of pairs of protruding ribs which engage the end of sheets moved by said rotation of said feed roller, a stack of individual sheets supported by said surface for supporting, said individual sheets being flexible to permit said sheets to contact said plurality of pairs of protruding ribs when two sheets are moved together from said stack by said feed roller, the improvement comprising a slat with a plurality of protrusions along an exterior surface thereof disposed between each of said protruding ribs and engaging said end of said upper sheet when said upper sheet is advanced, said plurality of protrusions substantially centered on a median line thereof and arranged in a hopscotch pattern of alternating single and double protrusions, whereby said upper and lower sheets strike said plurality of protrusions to fan out and separate from each other.

* * * * *